US007154057B2

(12) United States Patent
Gaboury et al.

(10) Patent No.: US 7,154,057 B2
(45) Date of Patent: Dec. 26, 2006

(54) TELESCOPIC SWITCH

(75) Inventors: Daniel Gaboury, St-Augustin-De-Desmaures (CA); Marc-Andre Lajoie, Ste-Foy (CA)

(73) Assignee: General Electric Canada, Mississauga (CA)

( * ) Notice: Subject to any disclaimer, the term of this patent is extended or adjusted under 35 U.S.C. 154(b) by 0 days.

(21) Appl. No.: 11/367,359

(22) Filed: Mar. 6, 2006

(65) Prior Publication Data

US 2006/0219531 A1 Oct. 5, 2006

(30) Foreign Application Priority Data

Mar. 31, 2005 (CA) ..... 2502806

(51) Int. Cl.
*H01H 3/18* (2006.01)

(52) U.S. Cl. ..... 200/48 R; 200/48 V

(58) Field of Classification Search ..... 200/48 R, 200/48 V, 48 SB, 52 R
See application file for complete search history.

(56) References Cited

U.S. PATENT DOCUMENTS 3,562,465 A * 2/1971 Turgeon ..... 200/501
4,188,516 A * 2/1980 Patel et al. ..... 200/48 R
4,504,708 A * 3/1985 Hartig ..... 200/48 V
4,568,808 A * 2/1986 Thuries et al. ..... 200/48 V
6,946,609 B1 * 9/2005 Lajoie et al. ..... 200/336

* cited by examiner

*Primary Examiner*—Richard K. Lee

(57) ABSTRACT

A high voltage, high current telescopic disconnect switch suitable for use in isolated phase bus duct has two fixed conductors and a movable telescopic conductor coaxially disposed within the first fixed conductor and movable to a closed position bridging the first and second fixed conductors. A plurality of contact fingers are mounted to the fixed conductors and have contact surfaces that extend into engagement with the telescopic conductor to make electrical contact between the fixed conductors through the telescopic conductor when in a closed position. The contact surface of each of the fingers comprises a first tip portion that extends beyond the fixed conductor and has a first radius that is slightly greater than the radius of the telescopic conductor so that the first tip portion presents an arcuate width that overlies in wiping electrical contact the telescopic conductor when in the closed position.

14 Claims, 5 Drawing Sheets

TELESCOPIC SWITCH

FIELD OF THE INVENTION

The present invention relates generally to electrical switches and, more particularly, to high voltage, high current telescopic disconnect switches suitable for use in isolated phase bus duct.

BACKGROUND OF THE INVENTION

Utility company power plants have large generators typically generating at medium voltages of, for example, 13,800 volts to 34,000 volts and current ratings of 5,000 amps to 30,000 amps. Typically this voltage is stepped up by transformers to much higher voltages in order to transmit the energy over long distances. The connection between the generator and the step-up power transformer is usually made by isolated phase bus duct. The bus duct usually comprises three phase conductors each comprising an inner conductor and a outer conductive housing surrounding, and electrically insulated from, the inner conductor.

A circuit breaker is typically provided in the isolated bus duct to protect the generator by isolating the generator in the event of a short circuit condition or a fault in the step-up transformer. To service the generator, the circuit breaker is opened and then the disconnect switch is opened to isolate the generator.

The disconnect switch utilized to isolate the generator may comprise a telescopic switch. The telescopic disconnect switch also finds application in a pump storage plant as a phase reversal switch. The telescopic switch comprises two fixed or stationary conductors and a hollow moveable cylindrical conductor which resides in a first one of the fixed conductors and telescopes between first and second positions to engage and disengage, respectively, contact fingers on a second one of the fixed conductors. Contact between both of the fixed conductors and the moving cylindrical conductor is made by contact fingers mounted on the circumference of both fixed conductors. The moving conductor has a smaller diameter than the two fixed conductors and moves along the same axis as the fixed conductors to slide inside one of the fixed conductors until it reaches the fully opened position. The contact fingers have two flat contact surface portions. The first flat contact surface portion contacts one of the fixed cylindrical conductors along a point of contact engagement and the flat second contact portion extends beyond the fixed conductor for sliding wiping engagement and contact along another point of contact engagement with the movable cylindrical conductor. The contact points of engagement provide an effective electrical engagement however the points also limit the surface making electrical contact between the telescopic conductor and the fixed conductor.

These existing telescopic disconnect switches with the contact fingers having the flat contact surface portion are able to operate between open and closed positions for cycles of about 500 operations before major maintenance of the telescopic switch is required. There is now a market driven requirement that these telescopic switches operate for more than 500 operations before requiring maintenance servicing. Accordingly, any improvements in the telescopic switch that enhances the number of operating cycles would be advantageous.

BRIEF DESCRIPTION OF THE INVENTION

The present invention relates to a high voltage, high current telescopic switch suitable for use in isolated phase bus duct. The telescopic switch has two stationary or fixed conductors and a movable telescopic conductor coaxially disposed with the first fixed conductor and movable to a closed position bridging the first and second fixed conductors. A plurality of electrically conductive contact fingers are mounted to the fixed conductors and have contact surfaces that extend into engagement with the telescopic conductor to make electrical contact between the fixed conductors through the telescopic conductor when in a closed position. The contact surface of each of the fingers comprises a first tip portion that extends beyond the fixed conductor and has a first radius that is slightly greater than the radius of the telescopic conductor so that the first tip portion presents an arcuate width that overlies in wiping electrical contact the telescopic conductor when in the closed position.

In another embodiment, the contact fingers each have a fixed contact surface tip portion that engages a groove in the fixed conductor. The fixed contact surface tip portion has a second radius slightly larger than the radius of the groove of fixed conductor so that an arcuate width of the tip portion extends into the groove in electrical contact therewith.

The contact surface made by each of the tip portions of each of the fingers with the telescopic conductor and one of the fixed conductors is increased by the present invention. This increase in contact surface from a point of engagement to a line of engagement reduces contact resistance and improves current capacity while maintaining acceptable temperature rise at the contact. An increase in contact finger conductivity and current capacity is achieved by the present invention while improving wear effect on the contact surface tip portions resulting in more cycles of operation of the telescopic switch between maintenance servicing.

In one embodiment there is provided a telescopic switch for use in isolated phase bus duct. The switch comprises first and second spaced apart and axially aligned fixed conductors. The first and second fixed conductors have adjacent end portions each supporting a plurality of individual contact fingers circumferentially positioned thereabout. The switch further comprises a telescopic conductor coaxially disposed with the first fixed conductor and axially moveable between an open position where the telescopic conductor is spaced apart from the second fixed conductor and a closed position where the telescopic conductor bridges the first and second fixed conductors. The telescopic conductor has first outside contact wall surface portions of a first predetermined radius. Each of the individual contact fingers comprises first and second finger contact surface portions. The second contact finger surface portion is held in engagement with a corresponding one of the adjacent end portions of the first and second fixed conductors. The first finger contact surface portion comprises a first contact surface tip portion extending beyond the corresponding one of the adjacent end portions of the first and second conductors, the first contact surface tip portion is of first concave arc shaped width of first radius slightly greater than the first predetermined radius. The first contact surface tip portion overlies in wiping electrical contact one of the first outside contact wall surface portions of the telescopic conductor when in the closed position.

BRIEF DESCRIPTION OF THE DRAWINGS

For a better understanding of the nature and objects of the present invention reference may be had by way of example to the accompanying diagrammatic drawings in which.

DETAILED DESCRIPTION OF THE INVENTION

Figure 1:
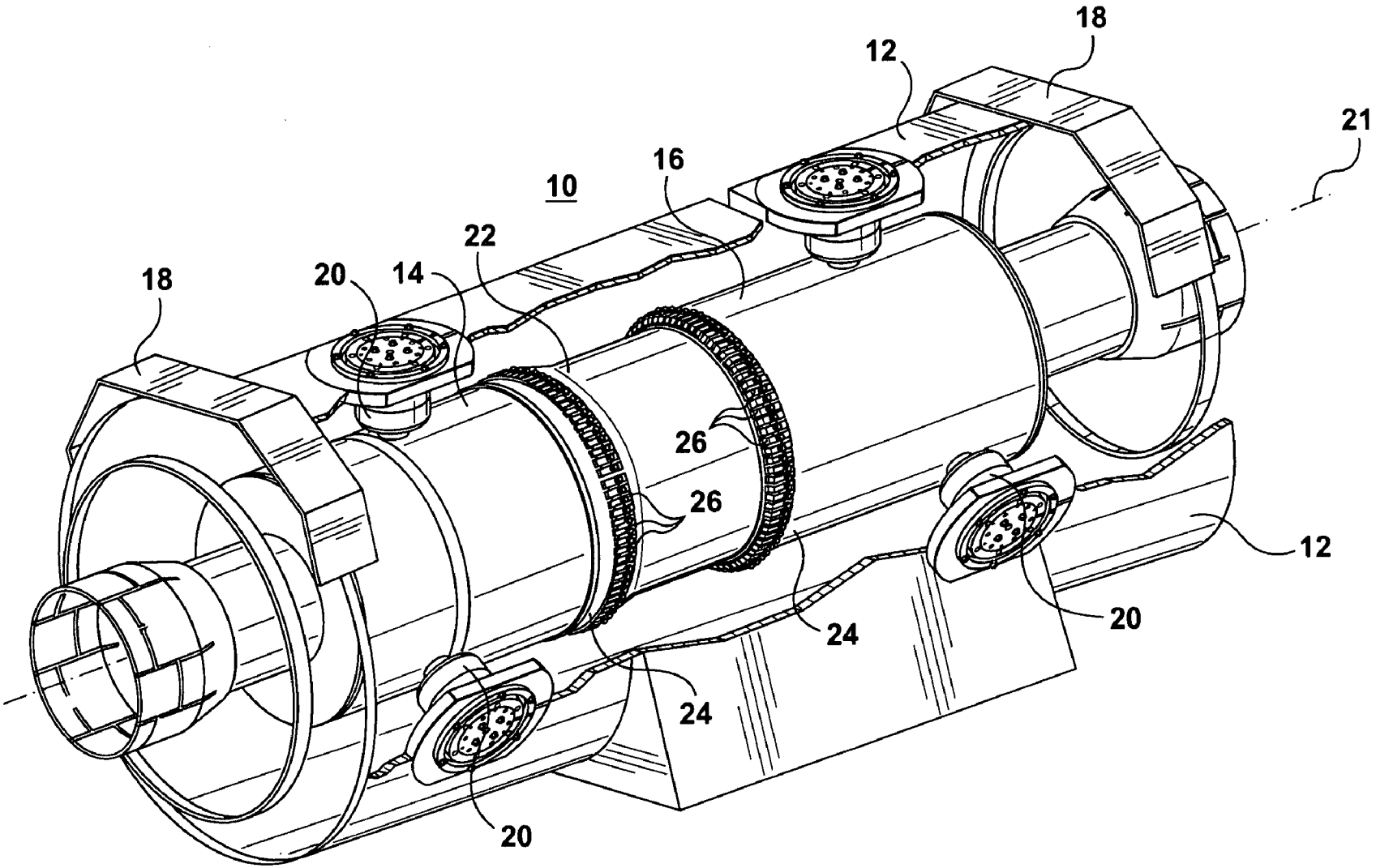
FIG. 1 is a perspective view of a telescopic switch embodying the present invention.

Referring to FIG. 1 there is shown an embodiment of a telescopic switch 10 that is exemplary of the switch embodying the present invention. Switch 10 is suitable for use in one phase of an isolated phase bus duct. Although not illustrated in FIG. 1, it should be understood that three switches each similar to switch 10 may be adapted to be inserted in respective phases of a three-phase isolated phase bus bar distribution system at a point where it is desired to have circuit opening and closing capabilities. Similarly, appropriate connectors (not shown) are used to join the switch 10 to the corresponding conductors of the distribution system. It should further be understood that the telescopic switch of the present invention may be used for any type of system employing a housed or enclosed bus.

Referring to FIG. 1, the telescopic switch 10 comprises an outer enclosure 12 shown partially broken away. The outer enclosure 12 is generally cylindrical in shape, is hollow, and comprises a conductive material. The enclosure 12 has hanger brackets 18 which may be used for mounting the telescopic switch 10. The telescopic switch 10 further comprises first and second stationary or fixed conductors 14 and 16, respectively. Conductors 14 and 16 are located within the hollow enclosure 12 and are each supported relative to the hollow enclosure 12 by three insulated support legs 20 spaced apart 120 degrees around the conductors 14,16.

The first and second fixed conductors 14, 16 are spaced apart from each other and axially aligned along axis 21. The first and second fixed conductors 14, 16 are generally cylindrical in shape and are hollow.

Figure 4:
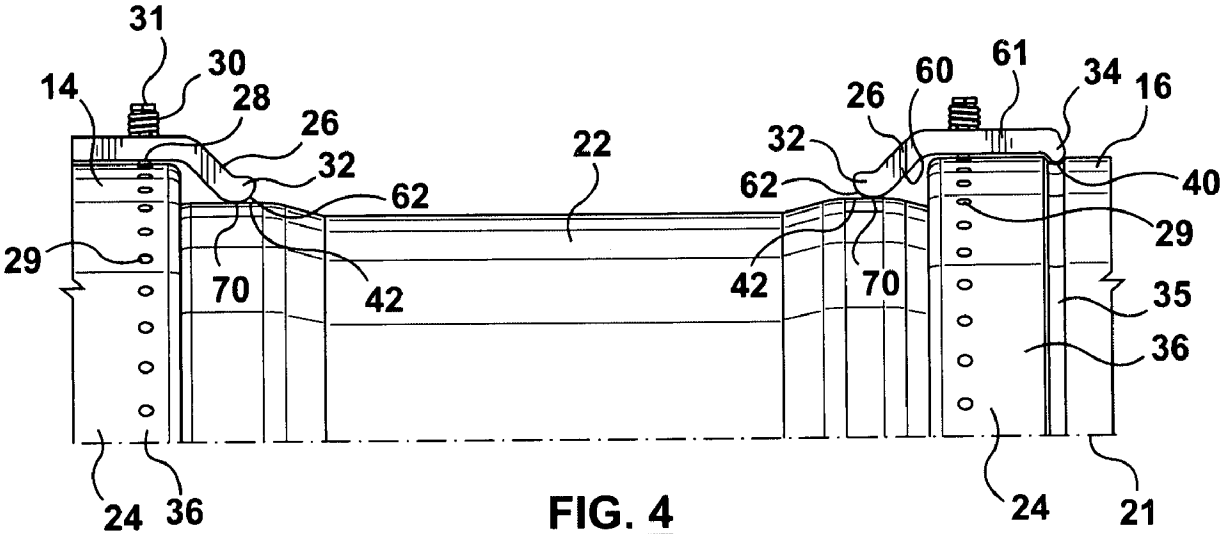
FIG. 4 is a partial side sectional view of the telescopic switch shown in the closed position.
Figure 5:
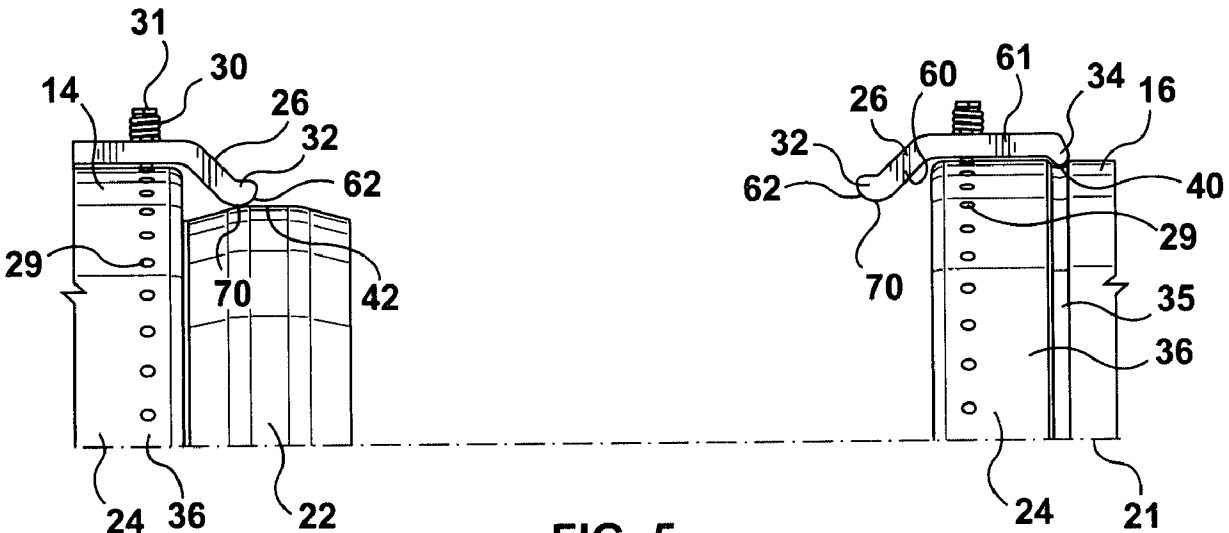
FIG. 5 is a partial side sectional view of the telescopic switch shown in the open position.

Shown in FIG. 1 bridging the first and second fixed conductors 14 and 16 is a telescopic conductor 22. The telescopic conductor 22 is a hollow cylindrical shaped conductor that also extends along the axis 21 and is co-axial with the first fixed conductor 14. The outer radius of the telescopic conductor 22 is chosen to be less than the radius the inside surface of the first fixed conductor 14 which allows for the conductor 22 to be moved axially along axis 21 for retraction into the first fixed conductor 14. When retracted the telescopic conductor 22 is spaced from the second fixed conductor 16 to effectively open the circuit of switch 10. Movement of the telescopic conductor 22 is controlled by a transmission or gearing mechanism (not shown). The telescopic conductor 22 is shown in FIGS. 1 and 4 in a closed position closing the circuit, and bridging the space, between the first fixed conductor 14 and the second fixed conductor 16. The telescopic conductor 22 is shown in its open position in FIG. 5.

Figure 2:
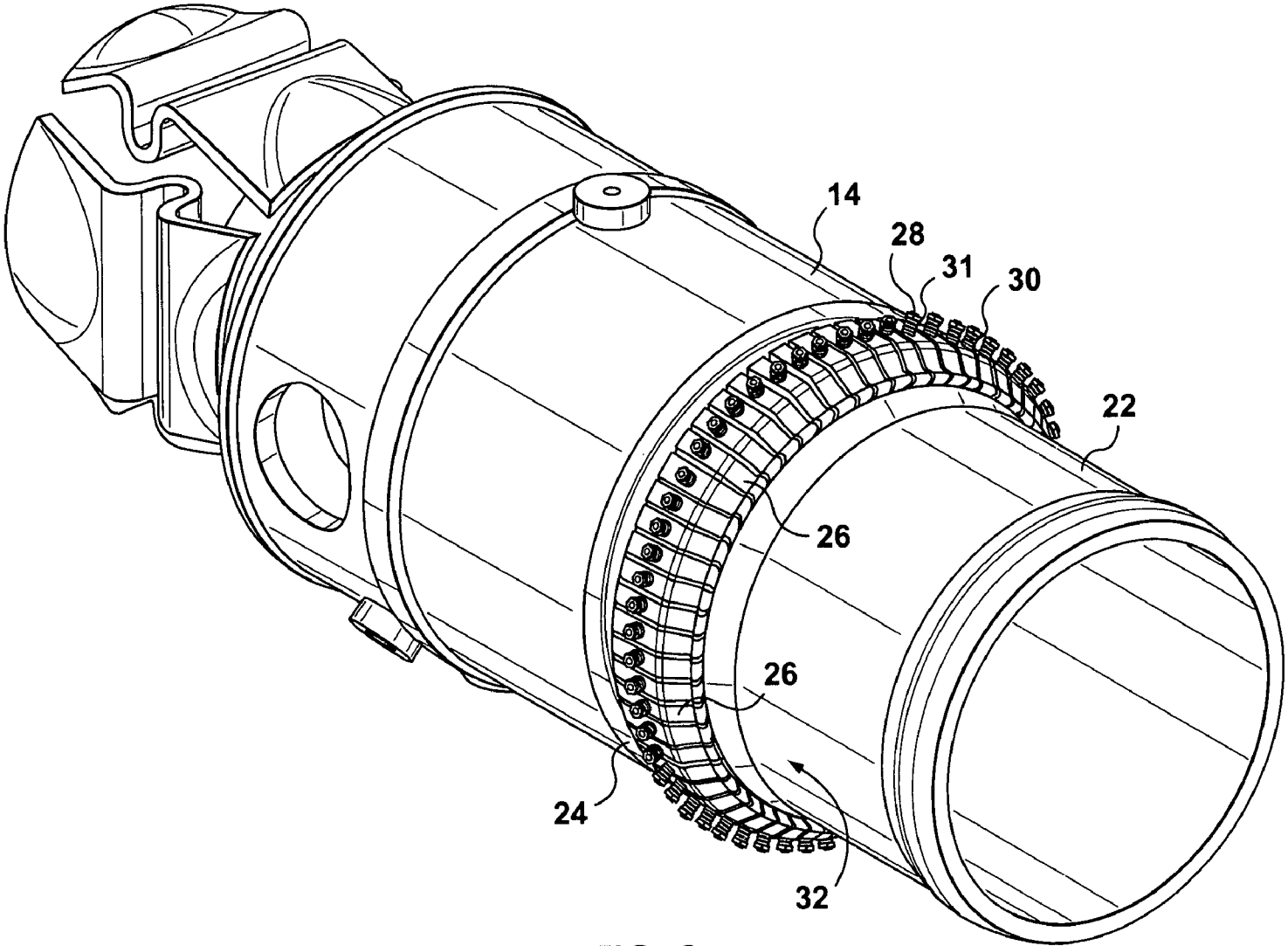
FIG. 2 is a perspective view showing one fixed conductor, the telescopic conductor and the fingers of the present invention.
Figure 3:
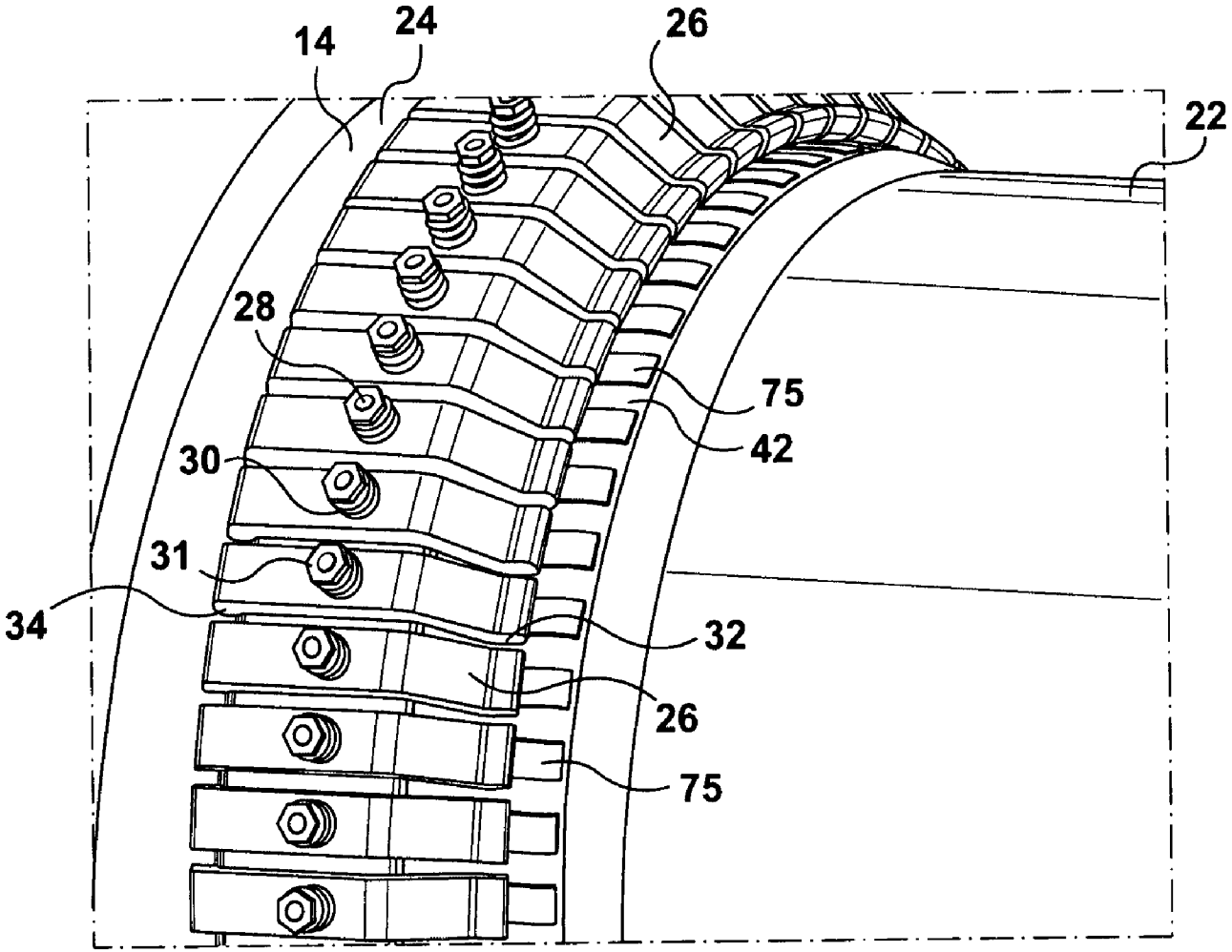
FIG. 3 is an enlarged perspective view of a portion of the telescopic switch of FIG. 2.

Each of the fixed conductors 14 and 16 has adjacent end portions 24 that support a plurality of individual electrically conductive contact fingers 26 which are circumferentially positioned about adjacent end portions 24 of the first and second fixed conductors 14, 16. As better seen in FIGS. 2 through 5, the contact fingers 26 are secured either to the fixed conductor 14 or the fixed conductor 16 by means of bolts 28 passing through apertures 27 (FIG. 7) in the fingers 26 and through aperture 29 in the fixed conductors 14, 16. The bolts 28 each have a head portion (not shown) countersunk into the inner surface of the fixed conductors 14, 16 so that the bolt heads do not to touch the telescopic conductor 22. A compression spring 30 is placed over a threaded end portion of the bolt 28 and a nut 31 is tightened on the threaded end portion of the bolt 28 to control the compression force of the spring 30 on the finger 26. The mounting of the individual contact fingers 26 to either the first or second fixed conductor 14, 16, present a jaw like configuration 32 (FIG. 2) which makes electrical contact with the telescopic conductor 22.

Referring to FIGS. 4 to 7, each of the individual contact fingers 26 has first and second finger contact surface portions 32 and 34 respectively. The contact surface portions 32, 34 are spaced apart by intermediate link arms 60 and 61. Link arm 60 is bent to provide finger end portions 62 that converge towards the telescopic conductor 22. Collectively, the finger end portions 62 of all the fingers 26 mounted to each of the adjacent end portions 24 present the jaw-like configurations 32.

Figure 6:
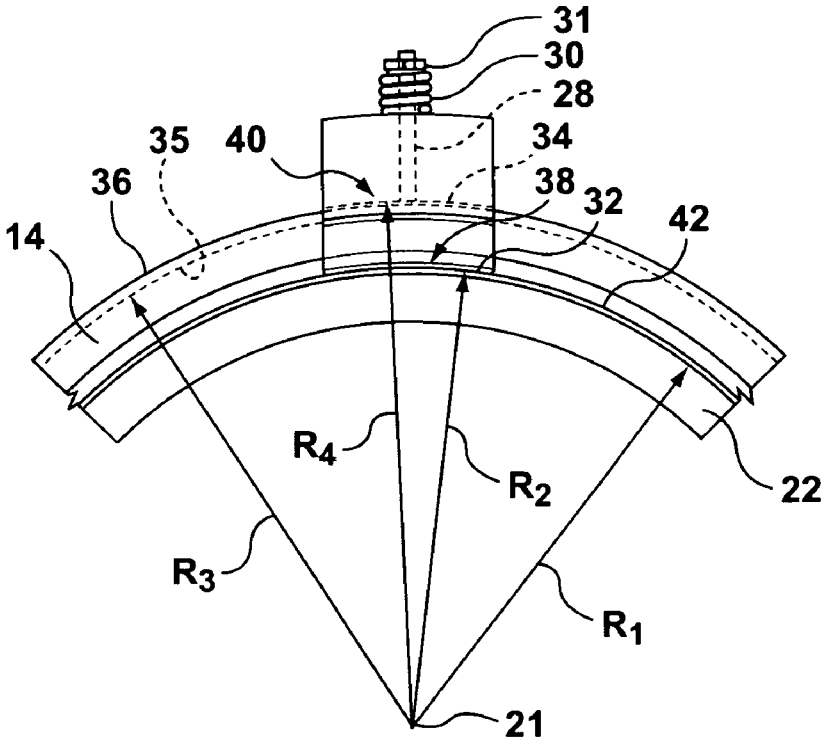
FIG. 6 is an end view of one of the contact fingers shown in FIG. 4; and, FIG. 7 is a bottom perspective view of a contact finger.
Figure 7:
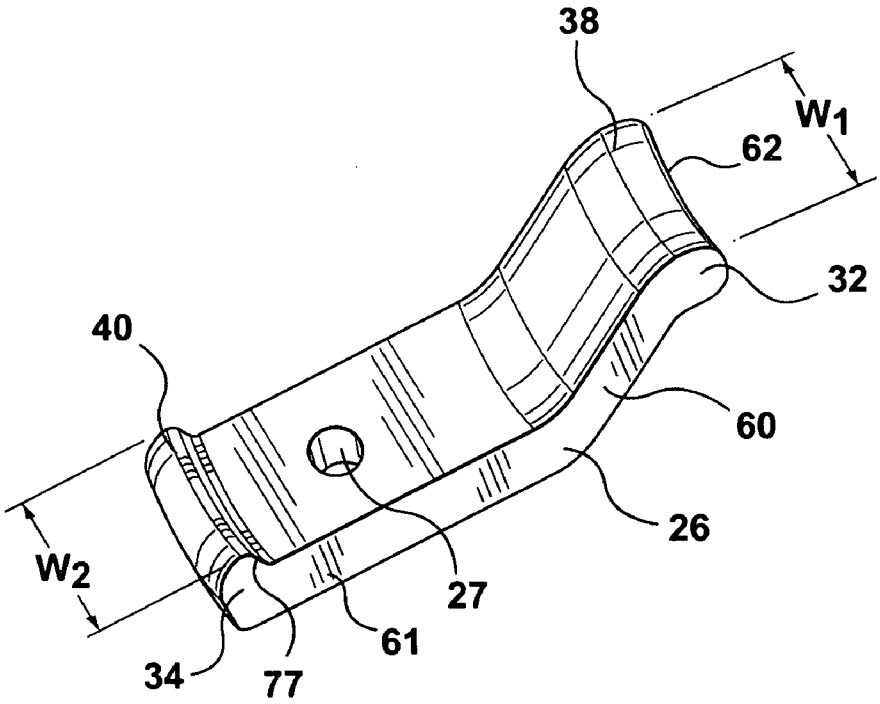

The first contact surface portion 32 of each finger 26 comprises a contact tip portion 38 that extends beyond conductor 14 or 16. The contact tip portion 38 makes contact with a corresponding raised contact surface outside wall portion 42 (FIG. 4) of the telescopic conductor 22. The contact surface tip portion 38 (as best seen in FIG. 7) has a first concave arc shaped line of width $W_1$. The contact arc associated with width $W_1$ has a radius $R_2$ shown in FIG. 6 which is slightly greater than, the radius $R_1$ of the first contact surface wall portion 42 of telescopic conductor 22. This permits the first contact surface tip portion 38 to overlie in wiping electrical contact the first outside wall contact surface portion 42 of the telescopic conductor 22 when in the closed position. The arcuate line of contact of contact surface tip portion 38 is best shown in FIGS. 6 and 7. The wiping effect of this line of contact with the outside wall portion 42 of the telescopic conductor 22 is shown, for illustrative purposes only, as area 75 in FIG. 3.

The second contact finger surface portion 34 for each finger 26 comprises a second contact tip portion 40. The second contact finger surface portion 34 is shown in side view in FIG. 7 to be rounded. It should be understood that this rounded portion may be any shape, such as for example, triangular, so long as the shape provides an arcuate tip portion 40 described in more detail hereafter. The second contact finger surface portion 34 is shown mounted in or extending into a groove 35. Groove 35 is formed in each of the adjacent end portions 24 of the fixed conductors 14 and 16. The side curvature 77 of the second contact finger surface portion 34 permits the contact surface portion 34 to be wedged into groove 35. Consequently, as the telescopic conductor 22 is moved into the closed position shown in FIG. 4, the conductor 22 forces the finger 26 against the spring 30. This increases the contact mating force between contact surface tip portion 40 in the groove 35 at the end portions 24 of the conductors 14, 15. This mating arrangement between contact surface portions 34 and groove 35 also prevents any rotation of finger 26 about the axis of bolt 28 due to unbalanced loading of the first contact surface portion 32 during the closing operation of the switch 10.

Referring to FIG. 6, the groove 35 in the second outside wall portion 36 has a radius from the axis 21 shown to be $R_3$. The second contact finger surface tip portion 40 is an arcuate line or a second concave arc shaped line of width $W_2$. The concave arc shaped line associated with the width $W_2$ has a radius corresponding to $R_4$ shown in FIG. 6. Radius $R_4$ is chosen to be slightly greater than, the radius $R_3$. Consequently, the second contact surface tip portion 40 extends into the groove 35 in electrical contact therewith along the arcuate width of tip portion 40. It should be understood that the radius $R_3$ for the first and second fixed conductors 14 and 16 may be different resulting in the radius $R_4$ for the contact fingers 28 attached to the first fixed conductor 14 being different than the radius of the contact fingers 26 attached to the second fixed conductor 16.

It should be understood that end portions of the telescopic conductor 22 may be raised as a raised flange as shown, or alternatively, as circumferentially spaced apart raised pads to facilitate or alter the radius of the contact surface wall portions 42 of the telescopic conductor 22. Similarly, the adjacent end portions 24 of the first and second conductors 14 and 16 may comprise a raised collar as shown, or alternatively, circumferentially spaced apart raised collar pads to which the fingers 26 are attached by use of the bolts 28.

The contact fingers 26 in the embodiment shown comprise copper with silver plating. The contact surface tip portions 38, 40 of the fingers 26 are machined and silver plated to respectively provide radii $R_2$ and $R_4$ prior to assembly to fixed conductors 14, 16. It should be understood that the radius of each of the arcuate widths $W_1$ and $W_2$ respectively of the first and second contact surface tip portions 38, 40 are chosen respectively to be slightly greater than the width of the corresponding outside surface wall portions 42 of the telescopic conductor and the groove 35 of the fixed conductor because it has been found that during silver plating of the contact fingers 26, the silver plating is not evenly distributed over the contact tip portions. The silver plating tends to be deposited thicker adjacent the side walls of the contact fingers 26 creating high spots. As a result, if the radius of the contact tip portions 38, 40 is chosen to match the radius of the telescopic conductor or the groove, then contact between parts is limited to the high spots. By choosing the radii of the contact surface tip portions 38, 40 to be slightly greater, contact is not limited to the high spots but to a greater surface portion of the arcuate line width of the finger contact surface tip portions 38, 40. This line of contact increases with wear of the contact surface tip portion 38, 40.

It should be further understood, that while the present invention provides for arcuate width contact surface tip portions 38, 40 in the form of an arcuate contact line, during opening and closing of the contacts some wear occurs thickening the line of contact of the tip portions 38, 40 and thereby improving contact surface engagement.

The use of contact surfaces 32, 34 having concave arc curving contact surface tip portions 38, 40 with radii $R_2$, $R_4$ utilized in the present invention has been tested and compared to the use of flat surface contact surfaces. A first telescopic switch was built utilizing flat finger contact surface portions in accordance with prior art switches. This first switch built with the fingers having flat contact surface areas was rated for 12000 Amp service. A second switch built with fingers having curved contact surface tip portions 38, 40 in accordance with the present invention was also built for testing. Both switches used the same conductor and enclosure sizes. Both switches have undergone heat run and mechanical wear testing, with the following results shown in Table 1 below:

TABLE 1

| | Switch 1 - Straight Fingers | Switch 2 - Present Invention - Curved Fingers |
|---|---|---|
| Rating (Amps) | 12,000 | 13,000 |
| Conductor Temperature Rise [° C.] | 49 | 43 |
| Mechanical wear capacity - [Maximum Number of stroke (condition)] | 3,000 | >10,000 |

From the results of the testing, it can be seen that the telescopic switch made in accordance with the present invention has a higher amperage rating, smaller heat rise and improved mechanical wear over the use of flat contact surface fingers.

While the invention has been described in terms of various specific embodiments, those skilled in the art will recognize that the invention can be practiced with modifications within the spirit and scope of the invention disclosed.

What is claimed is:

1. A telescopic switch for use in isolated phase bus duct comprising:

first and second spaced apart and axially aligned fixed conductors, the first and second fixed conductors having adjacent end portions each supporting a plurality of individual contact fingers circumferentially positioned thereabout;

a telescopic conductor coaxially disposed with the first fixed conductor and being axially moveable between an open position where the telescopic conductor is spaced apart from the second fixed conductor and a closed position where the telescopic conductor bridges the first and second fixed conductors, and the telescopic conductor having first outside contact wall surface portions of a first predetermined radius; and, each of the individual contact fingers comprising first and second finger contact surface portions, the second contact finger surface portion being held in engagement with a corresponding one of the adjacent end portions of the first and second fixed conductors, and the first finger contact surface portion comprising a first contact surface tip portion extending beyond the corresponding one of the adjacent end portions of the first and second conductors, the first contact surface tip portion being of first concave arc shaped width of first radius slightly greater than the first predetermined radius, the first contact surface tip portion overlying in wiping electrical contact one of the first outside contact wall surface portions of the telescopic conductor when in the closed position.

2. The switch of claim 1 wherein the adjacent end portions of the first and second fixed conductors have second outside wall portions, the second outside wall portions each having a groove extending thereabout wherein the groove has a second predetermined radius, and wherein the second contact finger surface portion comprises a second contact surface tip portion of second concave arc shaped width of second radius slightly greater than the second predetermined radius, and the second contact surface tip portion extending into the groove in electrical contact therewith.

3. The switch of claim 2 comprising a bolt, compression spring and nut for each finger, the bolt passing through one of the fixed conductors and the finger, the bolt having a threaded portion extending beyond the finger, the compression spring being placed over the threaded portion and the nut tightened onto the threaded portion to provide a compression force forcing the second and first tip portions respectively into electrical contact with the groove and the first outside contact wall surface portion of the telescopic conductor.

4. The switch of claim 3 wherein the first and second fixed conductors are hollow and the adjacent end portions of the first and second fixed conductors are cylindrical.

5. The switch of claim 4 wherein the telescopic conductor is hollow and cylindrical.

6. The switch of claim 5 further comprising an enclosure of conductive material enclosing, and within which, the first and second fixed conductors are mounted by insulators.

7. The switch of claim 2 further comprising an enclosure of conductive material enclosing, and within which the first and second fixed conductors are mounted by insulators.

8. The switch of claim 2 wherein the first and second fixed conductors are hollow and the adjacent end portions of the first and second fixed conductors are cylindrical.

9. The switch of claim 8 wherein the telescopic conductor is hollow and cylindrical.

10. The switch of claim 9 further comprising an enclosure of conductive material enclosing, and within which, the first and second fixed conductors are mounted by insulators.

11. The switch of claim 1 further comprising an enclosure of conductive material enclosing, and within which, the first and second fixed conductors are mounted by insulators.

12. The switch of claim 1 wherein the first and second fixed conductors are hollow and the adjacent end portions of the first and second fixed conductors are cylindrical.

13. The switch of claim 12 wherein the telescopic conductor is hollow and cylindrical.

14. The switch of claim 13 further comprising an enclosure of conductive material enclosing, and within which, the first and second fixed conductors are mounted by insulators.

* * * * *